US010098512B1

(12) United States Patent
Premchand

(10) Patent No.: US 10,098,512 B1
(45) Date of Patent: Oct. 16, 2018

(54) TOILET SEAT LIFTER

(71) Applicant: Rendie Premchand, Jersey City, NJ (US)

(72) Inventor: Rendie Premchand, Jersey City, NJ (US)

( * ) Notice: Subject to any disclaimer, the term of this patent is extended or adjusted under 35 U.S.C. 154(b) by 0 days.

(21) Appl. No.: 15/431,978

(22) Filed: Feb. 14, 2017

(51) Int. Cl.
*A47K 13/10* (2006.01)
*A47K 13/24* (2006.01)

(52) U.S. Cl.
CPC ..... *A47K 13/10* (2013.01); *A47K 13/24* (2013.01); *A47K 2201/00* (2013.01)

(58) Field of Classification Search
CPC ..... A47K 13/10; A47K 13/24; A47K 2201/00
USPC ..... 4/246.1, 246.3, 246.4, 246.5
See application file for complete search history.

(56) References Cited

U.S. PATENT DOCUMENTS 2,954,565 A * 10/1960 Miller ..... A47K 13/10 292/255
5,437,066 A * 8/1995 Mills ..... A47K 13/24 362/191
6,615,412 B1 9/2003 Hammond
6,651,262 B1 * 11/2003 Tinsley ..... A47K 13/10 4/246.1
D641,458 S 7/2011 Mixon
8,230,529 B1 7/2012 Reid
D723,351 S 3/2015 Eldin
2003/0019023 A1 * 1/2003 Furukawa ..... A47K 13/10 4/420.4
2007/0000036 A1 * 1/2007 Jung ..... A47K 13/10 4/246.1
2008/0307572 A1 * 12/2008 Leutschaft ..... A47K 13/10 4/246.3
2009/0100581 A1 * 4/2009 Mixon ..... A47K 13/10 4/246.3
2011/0035866 A1 * 2/2011 Ricca ..... A47K 13/10 4/246.3
2012/0272443 A1 11/2012 Chamanara
2015/0107007 A1 * 4/2015 Chaput ..... A47K 13/105 4/246.3
2015/0272409 A1 10/2015 Cayabyab
2015/0351594 A1 * 12/2015 Veros ..... A47K 13/24 4/237
2016/0088984 A1 * 3/2016 Chen ..... A47K 13/24 4/234

(Continued)

FOREIGN PATENT DOCUMENTS

CN 1650790 A 10/2008

*Primary Examiner* — J. Casimer Jacyna
(74) *Attorney, Agent, or Firm* — Kyle A. Fletcher, Esq.

(57) ABSTRACT

The toilet seat lifter is a device that is adapted for use with toilet seats. The toilet seat lifter is a foot-operated device that is used to lift and lower the toilet seat in preparation of and during the use of a toilet. The toilet seat operates such that when a pedal is depressed, the toilet seat is lifted. The toilet seat lifter further comprises a spring, which lowers the toilet seat to its original position when the pedal is no longer depressed. The toilet seat lifter further comprises a lighting assembly. The lighting assembly includes a light attached to the toilet seat for use in darkness. The toilet seat lifter is further housed in a phosphorescent that further provides light for use in darkness. The toilet seat lifter comprises a floor assembly, a lift assembly, a seat linkage, a seat mount, and a light assembly.

13 Claims, 6 Drawing Sheets

(56) References Cited

U.S. PATENT DOCUMENTS

2016/0157683 A1* 6/2016 Helfrich ..... A47K 13/10
4/246.3

* cited by examiner

TOILET SEAT LIFTER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of domestic articles including sanitary equipment, more specifically, a lifting device adapted for use with toilet seats.

SUMMARY OF INVENTION

The toilet seat lifter is a device that is adapted for use with toilet seats. The toilet seat lifter is a foot-operated device that is used to lift and lower the toilet seat in preparation of and during the use of a toilet. The toilet seat operates such that when a pedal is depressed, the toilet seat is lifted. The toilet seat lifter further comprises a spring, which lowers the toilet seat to its original position when the pedal is no longer depressed. The toilet seat lifter further comprises a lighting assembly. The lighting assembly includes a light attached to the toilet seat for use in darkness.

These together with additional objects, features and advantages of the toilet seat lifter will be readily apparent to those of ordinary skill in the art upon reading the following detailed description of the presently preferred, but nonetheless illustrative, embodiments when taken in conjunction with the accompanying drawings.

In this respect, before explaining the current embodiments of the toilet seat lifter in detail, it is to be understood that the toilet seat lifter is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the toilet seat lifter.

It is therefore important that the claims be regarded as including such equivalent construction insofar as they do not depart from the spirit and scope of the toilet seat lifter. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
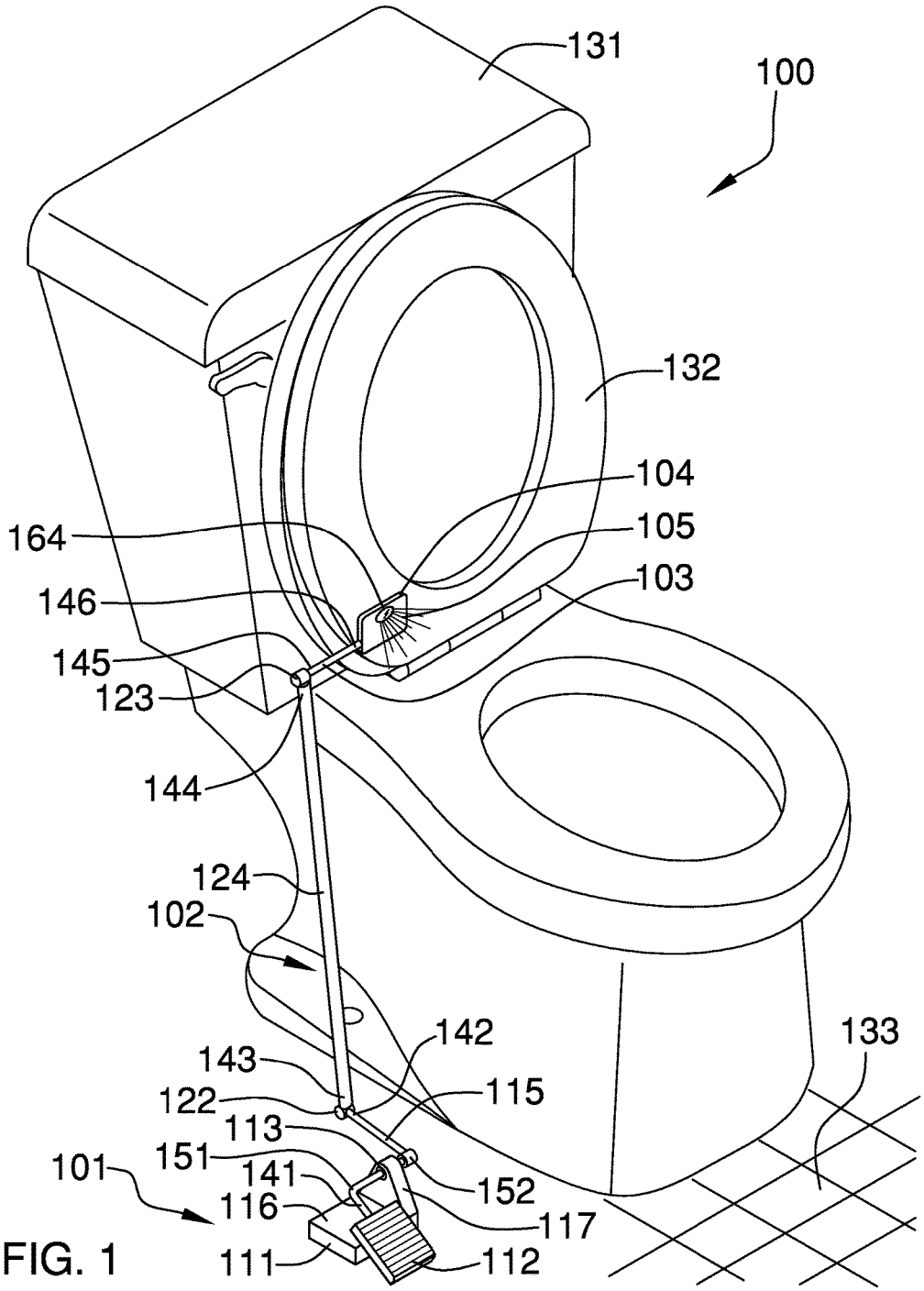
FIG. 1 is a perspective view of an embodiment of the disclosure.
Figure 2:
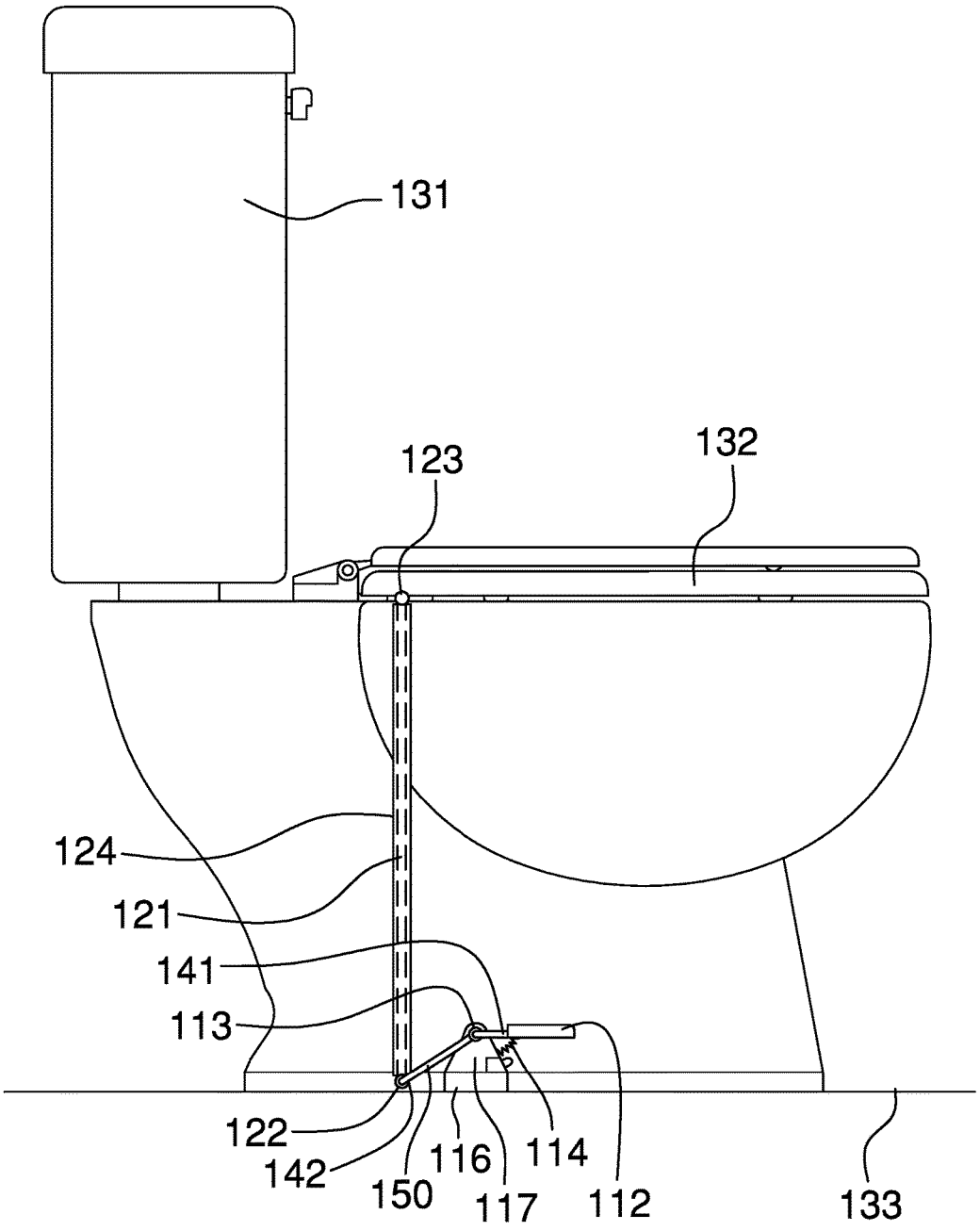
FIG. 2 is a side view of an embodiment of the disclosure.
Figure 3:
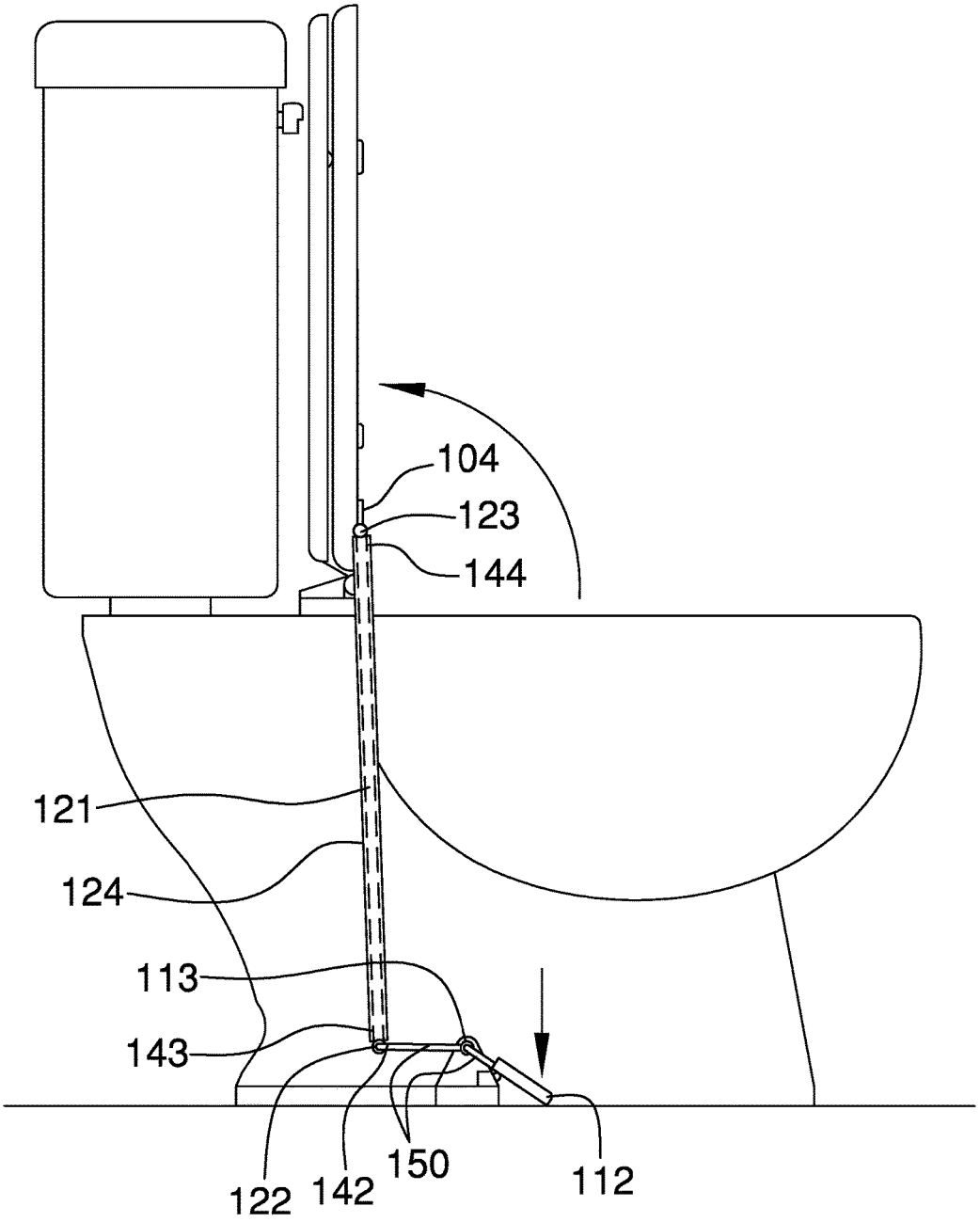
FIG. 3 is a side view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 6.

The toilet seat lifter comprises 100 (hereinafter invention) a floor assembly 101, a lift assembly 102, a seat linkage 103, a seat mount 104, and a light assembly 105. The floor assembly 101 is a lever-operated device, which raises and lowers the lift assembly 102 which, through the seat linkage 103 and the seat mount 104 raises and lowers the toilet 131 seat 132. The invention 100 is a device that is adapted for use with a toilet 131 seat 132. The invention 100 is a foot-operated device that is used to lift and lower the toilet 131 seat 132 in preparation for and during the use of a toilet 131. The invention 100 is a lever driven assembly that operates such that when a pedal 112 is depressed the toilet 131 seat 132 is lifted. The invention 100 further comprises an assembly, which lowers the toilet 131 seat 132 to its original position when the pedal 112 is no longer depressed. The invention 100 further comprises the lighting assembly 105. The lighting assembly 105 includes a light attached to the toilet 131 seat 132 for use in darkness. In some potential embodiments of the disclosure the invention 100 is further comprises a phosphorescent structure that further provides light for use in darkness. The floor assembly 101 attaches to the lift assembly 102, which attaches to the seat linkage 103, which attaches to the seat mount 104. The seat mount 104 is attached to the toilet 131 seat 132.

The floor assembly 101 comprises a floor mount 111, the pedal 112, a first pivot 113, a spring 114, and a pedal linkage 115. The pedal linkage 115 is a bent shaft 150 that further comprises a first end 141, a second end 142, a first corner 151, and a second corner 152. The floor mount 111 is a lever assembly that comprises a floor plate 116 and a triangular projection 117. The floor plate 116 is a structure shaped like a rectangular block that is intended to attach to the floor 133 next to the toilet 131. The triangular projection 117 is a triangular structure that projects perpendicularly away from the floor plate 116 in a direction away from the floor 133. The triangular projection 117 is fitted with an aperture 118. The aperture 118 is a hole formed through the triangular projection 117 such that the first pivot 113 can be inserted into the aperture 118. The first pivot 113 is a bearing that is described in more detail elsewhere in this disclosure. The pedal 112 is a foot pad that is used to operate the lever assembly of the floor mount 111.

The pedal linkage 115 is a bent shaft 150 that is further defined with a first end 141, a second end 142, a first corner 151, and a second corner 152. As shown most clearly in FIG. 1, the first corner 141 is a 90-degree bend that is formed in the bent shaft 150 between the first end 141 of the bent shaft 150 and the second end 142 of the bent shaft 150. The second corner 152 is a 90-degree bend that is formed in the bent shaft between the first corner 151 of the bent shaft 150 and the second end 142 of the bent shaft 150. The purpose of bent shaft 150 is to offset 147 the pedal 112 from the axis formed by the connection of the bent shaft 150 and the lift assembly 102. This offset 147 allows the pedal to act like a lever that rotates the portion of the bent shaft 150 between the first corner 151 and the second corner 152 in such a manner that the portion of the bent shaft 150 between the second corner 152 and the second end 142 will raise and lower the lift assembly 103. The first end 141 of the bent shaft 150 is attached to the pedal 112. The second end 142 of the bent shaft 150 is attached to the lift assembly 102. The portion of the bent shaft 150 that is between the first corner 151 and the second corner 152 is inserted through the first pivot 113 such that the bent shaft 150 will rotate freely with a center of rotation that is aligned with the center axis of the portion of the bent shaft 150 that is between the first corner 151 and the second corner 152.

The spring 114 is a readily and commercially available helical coil compression spring that connects the pedal 112 and the floor plate 116 such that when the pedal 112 is depressed mechanical energy is stored within the spring 114. When the pedal 112 is released, the stored energy returns the pedal 112 to its original position thereby returning the toilet 131 seat 132 to the down position.

In the first potential embodiment of the disclosure, the floor mount 111 is formed as a single unit from molded plastic. Suitable plastics include, but are not limited to, polyethylene, polyvinylchloride, and polypropylene. The floor mount 111 is attached to the floor 133 using an adhesive. The bent shaft 150 is formed from pipes and fittings that are readily and commercially available for plumbing applications.

The lift assembly 102 comprises a lift shaft 121, a second pivot 122, and a third pivot 123. The lift shaft 121 is a pipe that is readily and commercially available for plumbing applications. The lift shaft 121 is further defined with a third end 143 and a fourth end 144. The second pivot 122 is a readily and commercially available ball and socket joint. The third pivot 123 is a bearing. The second pivot 122 is attached to the third end 143 of the lift shaft 121. The third pivot 123 is attached to the fourth end 144 of the lift shaft 121. The second end 142 of the bent shaft 151 is attached to the second pivot 122. The purpose of the second pivot 122 is to reduce the strain placed on the bent shaft 151 and the line shaft 121 caused by changes in the relative angle between the line shaft 121 and the bent shaft 151 as the toilet 131 seat 132 is lifted and lowered. The third pivot 123 is discussed elsewhere in this disclosure.

The seat linkage 103 is a shaft that is formed from a pipe that is readily and commercially available for plumbing applications. The seat linkage 103 is further defined with a fifth end 145 and a sixth end 145. The fifth end 145 is attached to the third pivot 123 by inserting the fifth end 145 into the bearing that forms the third pivot 123. The third pivot 123 allows for the rotation of the seat linkage 103 which is necessary to prevent stresses caused by the change in the relative angle between the toilet 131 seat 132 and the invention 100 as the toilet 131 seat 132 is lifted and lowered.

The seat mount 104 is a structure that is shaped like a rectangular block and that is intended to attach to the toilet 131 seat 132. The seat mount 104 is attached to the side of the toilet 131 seat 132 that is proximal to the water contained within the toilet 131 such that the seat mount 104 does not interfere with the occupancy of the toilet 131 seat 132. The sixth end 146 of the seat linkage 103 is attached to the seat mount 104. In the first potential embodiment of the disclosure, the seat mount 104 is attached to the toilet 131 seat 132 with an adhesive. The seat mount 104 is formed from molded plastic.

The lighting assembly 105 is an illumination device that is integrated to the invention 100 for night-time use. A passive light assembly and an active lighting assembly are disclosed.

In the first potential embodiment of the disclosure the passive light assembly is used. The passive light assembly is a luminescence 170 based assembly that uses phosphorescent materials to provide the light of the lighting assembly. In the passive light assembly, the floor mount 111 and the seat mount 104 are formed from a polymer solution that contains phosphorescent materials that, when the polymer is molded into the floor mount 111 or the seat mount 104, will be stimulated by the ambient radiation within the environment within which the invention 100 is placed and that will continue to emit light when the stimulating ambient radiation is discontinued. The pedal 112 is further formed from the above described polymer solution. The lift assembly 102 further comprises an optional lift housing 124. The optional lift housing 124 is further formed from the above described polymer solution. In the first potential embodiment of the disclosure, as shown most clearly in FIGS. 2, 3, and 5, the lift 121 is placed within the optional lift housing 124. In alternate embodiments of the disclosure, the pedal 112 and the lift shaft 121 are instead coated with a phosphorescent pigment.

Figure 4:
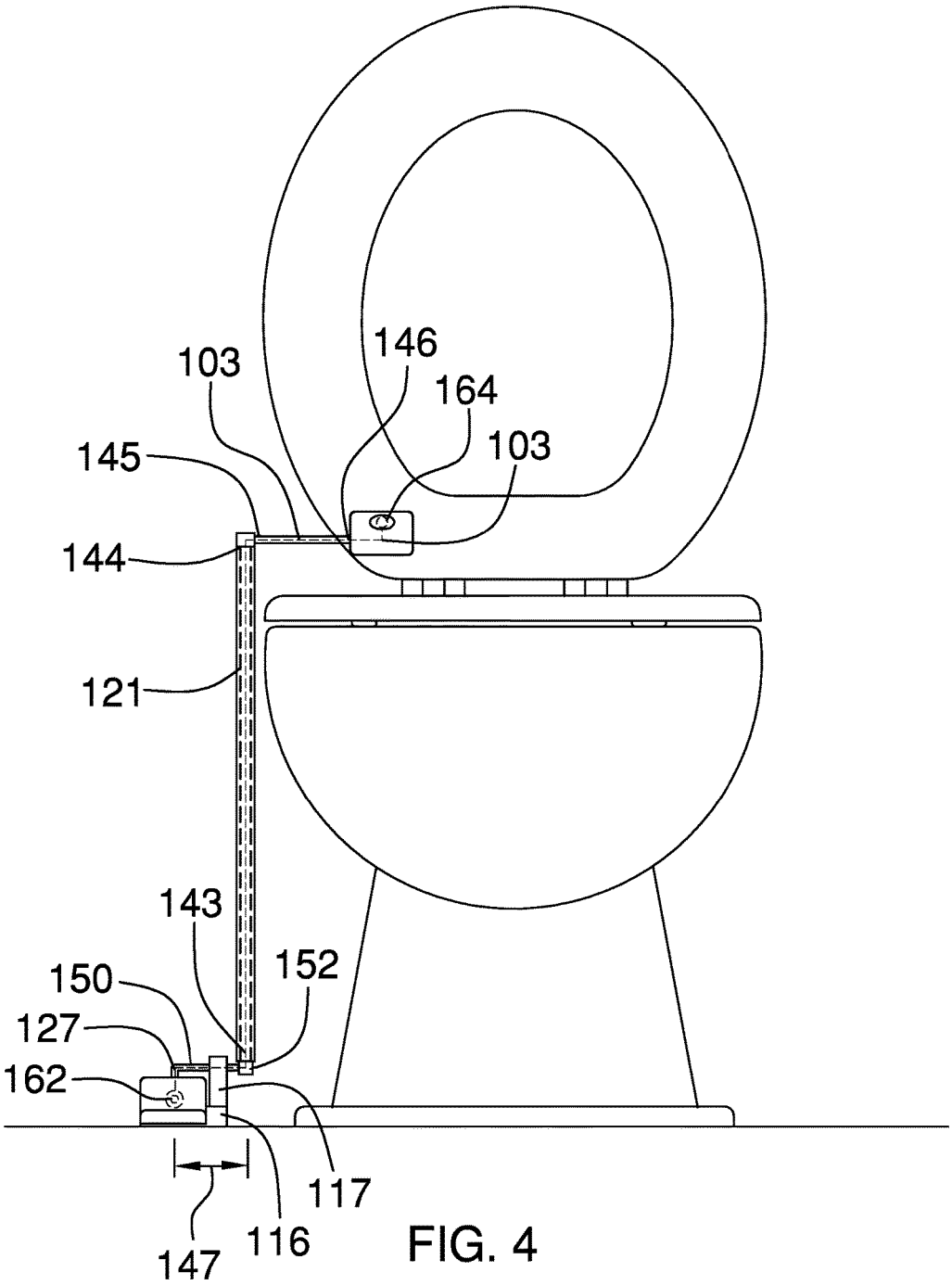
FIG. 4 is a front view of an embodiment of the disclosure.
Figure 5:
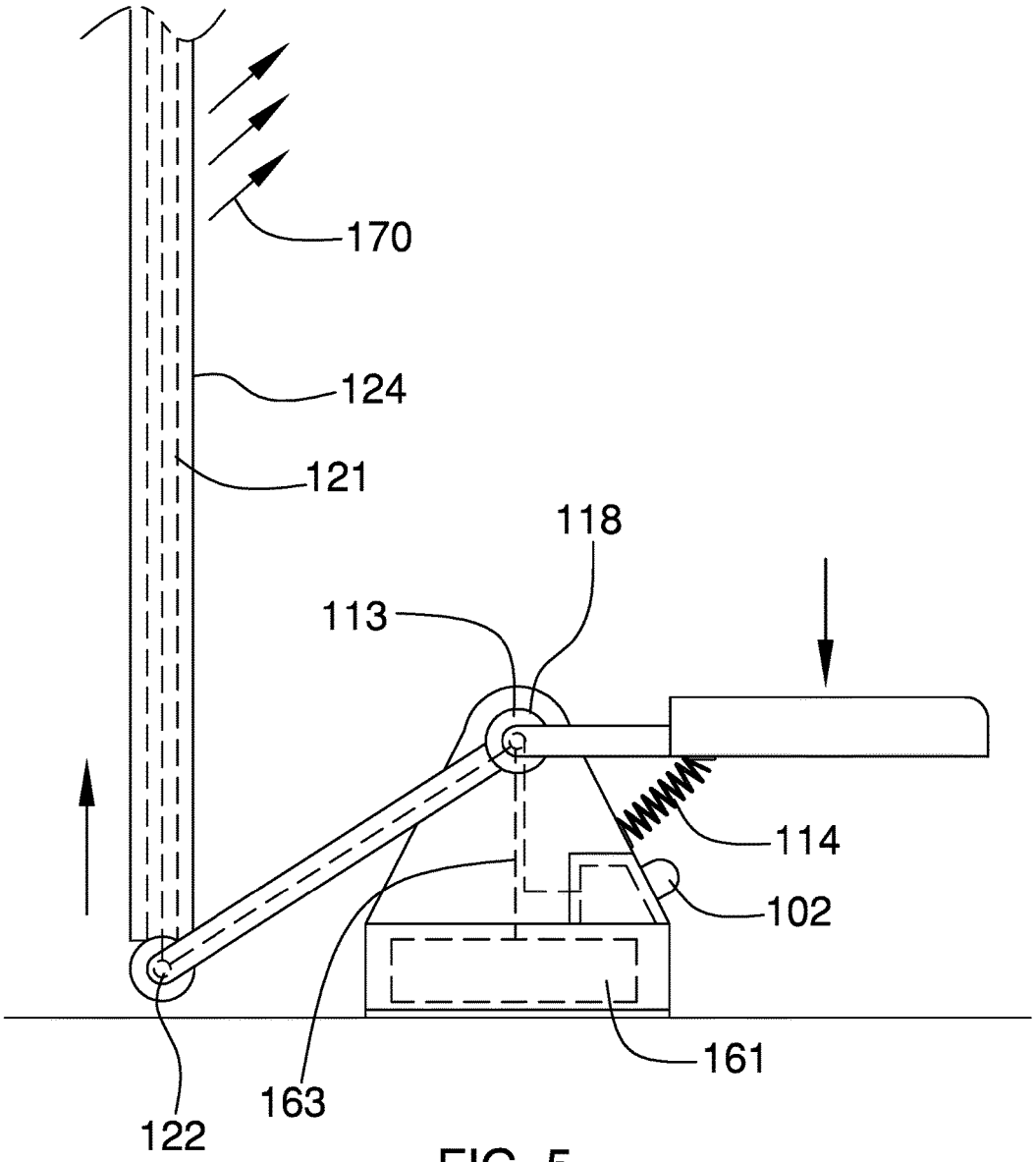
FIG. 5 is a detail view of an embodiment of the disclosure.
Figure 6:
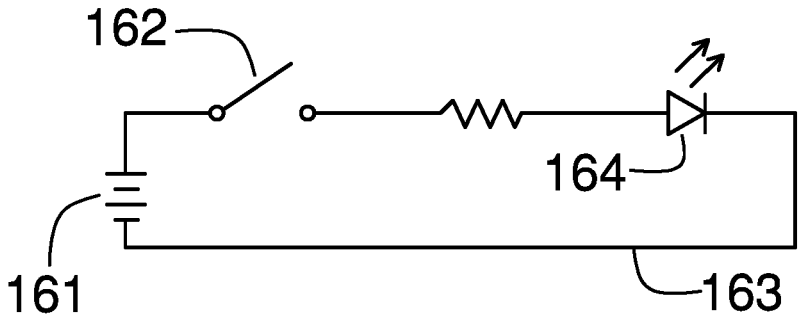
FIG. 6 is a schematic of an embodiment of the disclosure.

As shown in FIGS. 1, 4, and 6 the active light assembly comprises a battery 161, a switch 162, a cable 163, and a light 164. In the second potential embodiment of the disclosure, the light 164 is an LED. As shown in FIG. 6, the battery 161, switch 162, and light 164 are placed in a series circuit. As shown most clearly in FIG. 5, the switch 163 is a foot switch that is positioned underneath the pedal such that the switch 163 is activated when the pedal is depressed. As also shown in FIG. 5, the cable 163 is routed through the center of the bent shaft 150, the line shaft 121, and the seat linkage 103 such that the light 164 can be mounted on the seat mount 104.

To use the invention 100, the pedal 112 is stepped on.

The following definitions were used in this disclosure:

Adhesive: As used in this disclosure, an adhesive is a chemical substance that can be used to adhere two or more objects to each other. Types of adhesives include, but are not limited to, epoxies, polyurethanes, polyimides, or cyanoacrylates, silicone, or latex based adhesives.

Battery: As used in this disclosure, a battery is a container consisting of one or more cells, in which chemical energy is converted into electricity and used as a source of power.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; or, 4) the point, pivot, or axis around which something revolves.

Center Axis: As used in this disclosure, the center axis is the axis of a cylinder or cone like structure. When the center axes of two-cylinder or like structures share the same line they are said to be aligned. When the center axes of two-cylinder like structures do not share the same line they are said to be offset.

Center of Rotation: As used in this disclosure, the center of rotation is the point of a rotating plane that does not move with the rotation of the plane or a line within a rotating object that does not move with the rotation of the object.

Diode: As used in this disclosure, a diode is a two terminal semiconductor device that allows current flow in only one direction. The two terminals are called the anode and the cathode.

LED: As used in this disclosure, an LED is an acronym for a light emitting diode. A light emitting diode is a diode that is also a light source. Because of close operational correspondence of the function of the cathode and anode of an organic LEDs and the cathode and anode of a semiconductor LED, organic LEDs are included in this definition.

Luminescence: As used in this disclosure, luminescence is the emission of light through phosphorescence, fluorescence or bioluminescence by processes that derive energy from non-thermal sources such as chemical, biochemical, crystallographic changes, and the motion of subatomic particles or the excitation of an atomic system by radiation. This definition explicitly excludes light generated through incandescence: the light generated by hot objects.

Pedal: As used in this disclosure, a pedal is a foot operated lever that is used by the foot to power mechanical devices.

Phosphoresce: As used in this disclosure, to phosphoresce means to persist in emitting light, unaccompanied by sensible heat or combustion after exposure to and removal of stimulating radiation.

Phosphorescence: As used in this disclosure, phosphorescence is the light that is emitted from an object that is phosphorescing.

Phosphorescent: As used in this disclosure, phosphorescent is an adjective that is used to describe an object that exhibits or is capable of exhibiting phosphorescence.

Pipe: As used in this disclosure, the term pipe is used to describe a rigid hollow cylinder. While pipes that are suitable for use in this disclosure are often used to transport or conveys fluids or gasses, the purpose of the pipes in this disclosure are structural. In this disclosure, the terms inner diameter of a pipe and outer diameter are used as they would be used by those skilled in the plumbing arts.

Plate: As used in this disclosure, a plate is a smooth, flat and rigid object that has at least one dimension that: 1) is of uniform thickness; and 2) that appears thin relative to the other dimensions of the object. Plates often have a rectangular or disk like appearance. As defined in this disclosure, plates may be made of any material, but are commonly made of metals or plastics.

Switch: As used in this disclosure, a switch is an electrical device that starts and stops the flow of electricity through an electric circuit.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A lifting device comprising:

a floor assembly, a lift assembly, a seat linkage, a seat mount, and a light assembly;

wherein the lifting device is adapted for use with a toilet;

wherein the toilet is further defined with a seat;

wherein the lifting device raises and lowers the toilet seat;

wherein the lifting device is foot operated;

wherein the lifting device lowers the toilet seat to a predetermined position;

wherein the floor assembly is attached to a floor;

wherein the floor assembly is attached to the lift assembly, wherein the lift assembly is attached to the seat linkage;

wherein the seat mount is attached to the seat linkage;

wherein the light assembly is integrated into the seat mount;

wherein the seat mount is attached to the toilet seat;

wherein the lifting device is a lever operated device;

wherein the floor assembly comprises a floor mount, a pedal, a first pivot, a spring, and a pedal linkage;

wherein the floor mount is attached to the floor;

wherein the pedal is attached to the pedal linkage;

wherein the pedal linkage is attached to the first pivot;

wherein the first pivot is attached to the floor mount;

wherein the spring attaches the pedal to the floor mount;

wherein the pedal linkage is attached to the lift assembly;

wherein the floor mount comprises a floor plate and a triangular projection;

wherein the floor plate is a structure shaped like a rectangular block;

wherein the floor plate attaches to the floor;

wherein the triangular projection is a triangular structure that projects perpendicularly away from the floor plate in a direction away from the floor;

wherein the triangular projection is fitted with an aperture;

wherein the aperture is a hole formed through the triangular projection;

wherein the first pivot is inserted into the aperture;

wherein the pedal linkage is a bent shaft that further comprises a first end, a second end, a first corner, and a second corner;

wherein the first corner is a 90 degree bend that is formed in the bent shaft between the first end of the bent shaft and the second end of the bent shaft;

wherein the second corner is a 90 degree bend that is formed in the bent shaft between the first corner of the bent shaft and the second end of the bent shaft;

wherein the bent shaft offsets the pedal from the axis formed by the connection of the bent shaft and the lift assembly;

wherein the offset allows the pedal to act like a lever that rotates the portion of the bent shaft between the first corner and the second corner in such a manner that the portion of the bent shaft between the second corner and the second end will raise and lower the lift assembly.

2. The lifting device according to claim 1
wherein the first end of the bent shaft attaches to the pedal;
wherein the second end of the bent shaft attaches to the lift assembly;
wherein the portion of the bent shaft that is between the first corner and the second corner is inserted through the first pivot such that the bent shaft will rotate freely with a center of rotation that is aligned with the center axis of the portion of the bent shaft that is between the first corner and the second corner.

3. The lifting device according to claim 2
wherein the spring is a helical coil compression spring;
wherein the spring connects the pedal and the floor plate such that when the pedal is depressed mechanical energy is stored within the spring;
wherein when the pedal is released, the stored energy within the spring returns the pedal to its original position.

4. The lifting device according to claim 3
wherein the lift assembly comprises a lift shaft, a second pivot, and a third pivot;
wherein the lift shaft is further defined with a third end and a fourth end;
wherein the second pivot attaches to the third end;
wherein the fourth pivot attaches to the fourth end.

5. The lifting device according to claim 4 wherein the second end of the bent shaft is attached to the second pivot.

6. The lifting device according to claim 5
wherein the seat linkage is a shaft;
wherein the seat linkage is further defined with a fifth end and a sixth end;
wherein the fifth end is attached to the third pivot.

7. The lifting device according to claim 6
wherein the seat mount is a rectangular block structure;
wherein the seat mount is attached to the toilet seat.

8. The lifting device according to claim 7 wherein the sixth end of the seat linkage is attached to the seat mount.

9. The lifting device according to claim 8
wherein the floor mount is attached to the floor using an adhesive;
wherein the seat mount is attached to the toilet seat with adhesives.

10. The lifting device according to claim 9
wherein the line shaft is a pipe;
wherein the first pivot is a bearing;
wherein the second pivot is a universal joint;
wherein the third pivot is a bearing.

11. The lifting device according to claim 8
wherein the lifting device further comprises a lighting assembly;
wherein the lighting assembly is an illumination device;
wherein the illumination device is an electronic device;
wherein the electronic device comprises a battery, a switch, a cable, and a light;
wherein the battery, the switch, and the light are connected a series circuit with the cable.

12. The lifting device according to claim 11
wherein the switch is a foot switch that is positioned underneath the pedal such that the switch is activated when the pedal is depressed.

13. The lifting device according to claim 12
wherein the light is mounted on the seat mount;
wherein the light is an LED.

* * * * *